US005850867A

United States Patent [19]

Uzaki et al.

[11] Patent Number: 5,850,867

[45] Date of Patent: Dec. 22, 1998

[54] METHOD OF MAKING CORES WITH MOLDING SAND

[75] Inventors: Nagato Uzaki, Toyohashi; Masayoshi Kasazaki; Hisashi Harada, both of Hoi-gun; Kazuo Sugimoto, Toyokawa, all of Japan

[73] Assignee: Sintokogio, Ltd., Nagoya, Japan

[21] Appl. No.: 843,166

[22] Filed: Apr. 14, 1997

[30] Foreign Application Priority Data

Apr. 19, 1996 [JP] Japan ..... 8-122496
May 24, 1996 [JP] Japan ..... 8-153130

[51] Int. Cl.[6] ..... B22C 15/264; B22C 15/23

[52] U.S. Cl. ..... 164/22; 164/37

[58] Field of Search ..... 164/20, 21, 22, 164/37, 38, 39

[56] References Cited

U.S. PATENT DOCUMENTS 5,558,148 9/1996 Lizaki et al. ..... 164/37

*Primary Examiner*—Kuang Y. Lin
*Attorney, Agent, or Firm*—Limbach & Limbach L.L.P.

[57] ABSTRACT

A method of filling a core cavity, wherein the entire core cavity is uniformly filled with highly compacted sand for molding the core without the need of providing many ventholes. The method is characterized in that sand for molding the core is drawn into the core cavity through an inlet to preparatorily fill the cavity, and then the thus prepared sand is repeatedly and sequentially compacted by impulsively pressurizing the sand, starting with the sand farthest from the inlet and ending with the sand nearest to the inlet.

3 Claims, 2 Drawing Sheets

METHOD OF MAKING CORES WITH MOLDING SAND

FIELD OF THE INVENTION

This invention relates to a method of filling a core box with sand for molding the core so that it is uniformly filled with highly-compacted sand.

BACKGROUND

A blowing method, wherein sand for molding a core is blown along with compressed air, is used conventionally to fill a core box with the molding sand. Using the blowing method necessitates troublesome trial-and-error operations to make many ventholes in the core box. Besides, the blowing method has drawbacks in that since in the method a blow head, which has a built-in sand cylinder, is used, the structure of the blow head is complex, and necessitates troublesome work for its cleaning.

Despite such troublesome operations, the blowing method has still more problems in that if the cavity of a core has an oblong or complex shape, not all parts of the cavity can be filled uniformly with highly compacted sand for molding the core. This results in irregularities in the density of the compacted sand. There is also a problem in that if a high pressure is used to improve the effects of compacting the sand, the speed of the rushing sand particles increases so that release agents on the inside of a core box tend to come off. This generates stained sand.

This invention is made by considering the above problems. Its purpose is to provide a method that can uniformly fill every part of the cavity of a core with highly compacted sand for molding the core without the need of operations to make many ventholes in the core box even when the cavity has an oblong or complex shape.

DISCLOSURE OF INVENTION

To achieve the above purpose one method of this invention is characterized by the steps of preparatorily filling a core cavity with the sand for molding the core by blowing the sand into the core cavity after a blow head, into which the sand for molding the core has been thrown, is press-contacted with the upper surface of a core box having the core cavity and a sand-supply inlet, impulsively press-filling the parts of the core cavity, which are the farthest from the inlet, by abruptly introducing compressed air via a plurality of openings provided over the length of the core cavity at appropriate distances therebetween, and repeating the steps of impulsively press-filling the parts of the cavity, by sequentially changing the positions of the openings, via which compressed air is to be introduced, from the farthest to the nearest positions from the inlet.

Another method of this invention is characterized by the steps of preparatorily filling a cavity with sand for molding a core by depressurizing the cavity so that the sand is absorbed, after a blow head, into which the sand for molding the core has been thrown, is press-contacted with the upper surface of a core box having the core cavity and a supply inlet for the sand, impulsively press-filling the parts of the cavity that are the farthest from the inlet by abruptly introducing compressed air into a plurality of openings provided over the length of the cavity at appropriate distances therebetween, after the cavity and blow head are vacuum-depressurized, and repeating the step of impulsively press-filling the parts of the cavity, by sequentially changing the parts to be pressed from the farthest to the nearest positions from the inlet.

MODES FOR CARRYING OUT THE INVENTION

Figure 1:
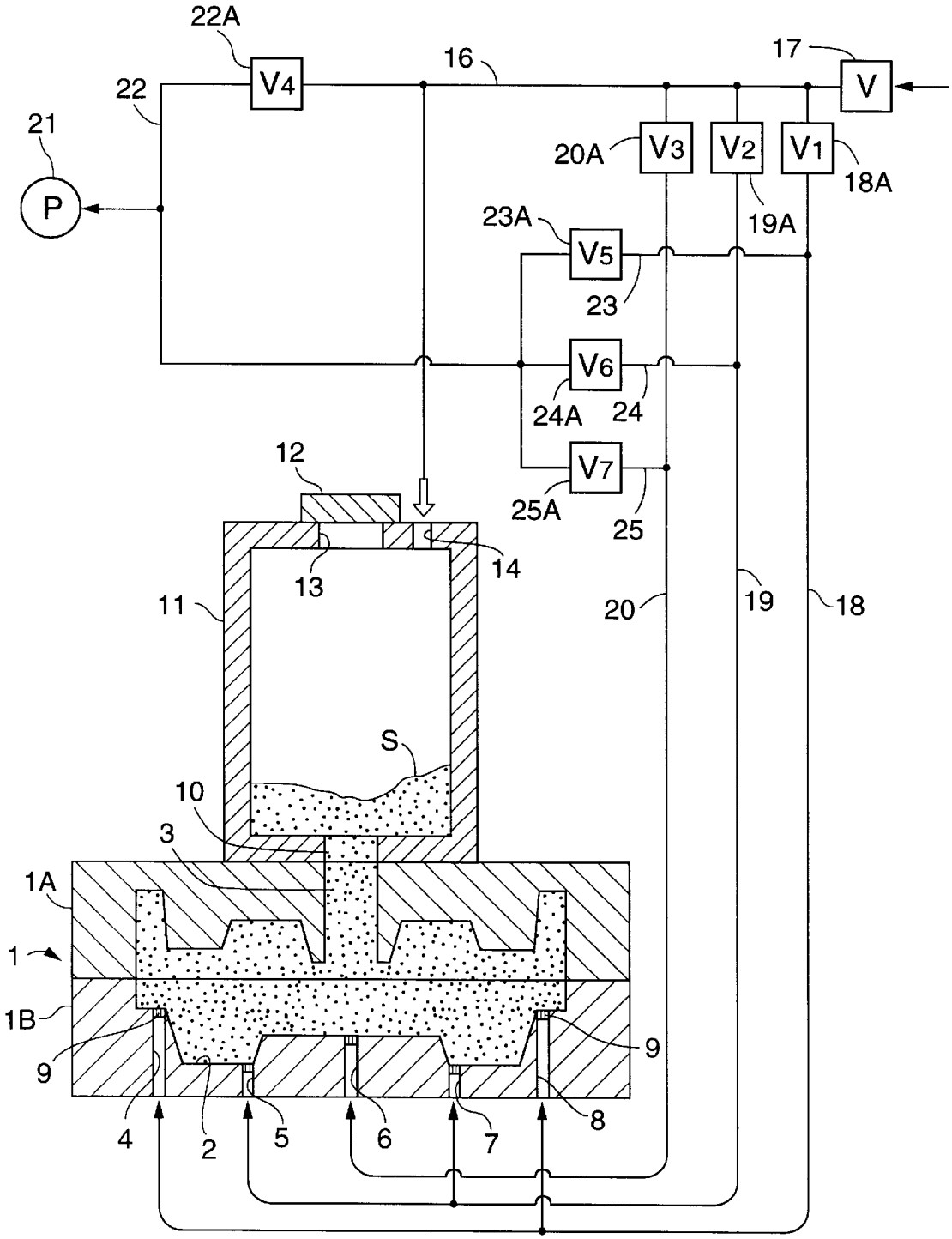
FIG. 1 is a section schematically showing the state wherein sand for molding the core is preparatorily drawn into a core cavity.

The embodiments of this invention will now be described in detail by reference to the drawings. In a first embodiment of this invention as shown in FIG. 1, a core box 1 is constituted by an upper mold 1A and a lower mold 1B so that the core is separable horizontally along a boundary therebetween. It has in its inside a laterally oblong core cavity 2 having a plurality of uneven surfaces in the up-and-down direction. A supply inlet 3 for sand is provided so that it upwardly passes through the center of the upper part of the core cavity 2. A plurality of ventholes 4–8 are provided at proper intervals therebetween in the bottom parts of the core cavity 2 so that they downwardly pass therethrough. Vent plugs 9 are engaged with respective ventholes 4–8. A blow head 11 is press-contacted with the upper part of the core box 1. A supply inlet 13 for sand, which is opened or closed by an opening-and-closing lid 12, is provided on the upper wall of the blow head 11.

A supply-discharge hole 14 is provided in the upper part of the blow head 11. The supply-discharge hole 14 communicates with a source of compressed air (not shown) via main piping 16 and a valve 17. Three branched pipes 18–20 are provided at positions downstream from the valve 17 in the main piping 16. The ends of the branched pipe 18 communicate with ventholes 4 and 8, the ends of the branched pipe 19 communicate with ventholes 5 and 7, and the end of the branched pipe 20 communicates with a venthole 6. The branched pipes 18–20 are equipped with valves 18A–20A. A suction pipe 22, leading to a vacuum pump 21, communicates via a closing valve 22A with the main piping 16. The main piping 16 also communicates via closing valves 23A–25A with branched suction pipes 23–25, which lead to the vacuum pump 21, and which are disposed in the branched pipes 18–20 at positions downstream of the valves 18A–20A. In the drawing molding sand is denoted by S.

The blow head 11, supplied with sand for molding the core, is press-contacted with the core box 1. A blow hole 10 of the head 11 communicates with the sand-supply inlet 3. The molding sand for the core in the blow head 11 is sucked into the core cavity 2 to fill it preparatorily (as in FIG. 1) after the core cavity 2 is depressurized by opening the valves 23A–25A (while the other valves are closed) through the sucking action of the vacuum pump 21. In this state not all of the corners of the core cavity are fully filled with highly-compacted sand S by just the sucking actions.

After the core cavity 2 that has been preparatorily filled with sand and the blow head 11 are depressurized by opening the valves 22A–25A, these valves 22A–25A are then closed, and simultaneously with this the valves 17 and 18A–20A are opened to abruptly supply compressed air via the blow head 11 and ventholes 4–8 into the core cavity 2, so that the upper parts of the sand S in the blow head 11 are press-pushed, and so that the parts in the cavity 2 positioned farthest from the sand-supply inlet 3 are filled with highly-compacted sand S. In this state the remaining parts of the sand for molding the core, e.g., sand between blow hole 10 and the middle part of core cavity 2, are prevented from being blocked by the actions of the pressure of the air introduced from upper and lower holes 14, 4, 5, 6, 7 and 8, so that the farthest end parts are effectively pressurized.

After the valves 17 and 18A–20A are closed, the valves 22A–25A are then opened so that the core cavity 2 and blow head 11 are depressurized. After that, the valves 22A–25A are closed, and simultaneously with this the valves 17, 19A, and 20A are opened so that compressed air is supplied into both the blow head 11 and the core cavity 2, via the ventholes 5, 6, and 7. Thus, the next farthest parts from the sand-supply inlet 3 (those positions that are farther away from the ventholes 5 and 7) of the core cavity 2 are filled with highly-compacted sand S. The central parts of the cavity 2 around the venthole 6 are also filled with highly compacted sand S by compressed air supplied via just the valves 17 and 20A. Thus, the sand S for the core, which has been preparatorily drawn into the core cavity 2, is uniformly and highly compacted all over the cavity. That is, the sand S is sequentially compacted, from the sand at the farthest positions to the sand at the nearest positions, from the sand-supply inlet 3, by sequentially changing the positions for supplying compressed air to sequentially pressurize the sand S.

Figure 2:
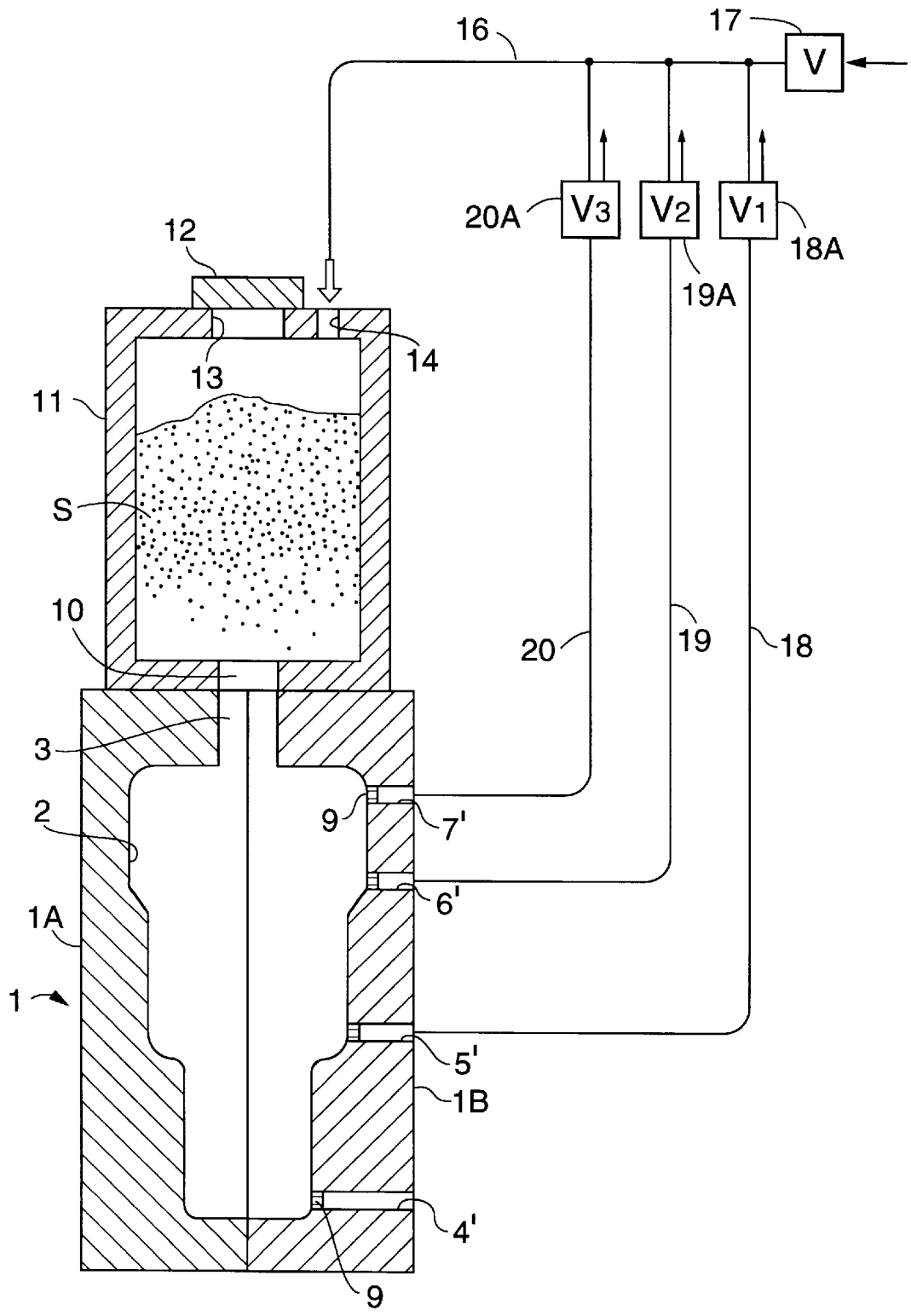
FIG. 2 is a section schematically showing the state wherein sand for molding the core is going to be preparatorily drawn into a core cavity.

A second embodiment of this invention will now be described by reference to FIG. 2. A core box 1 is constituted by a left mold 1A and a right mold 1B so that the core is separable vertically along the boundary therebetween. It has in its inside a vertically oblong core cavity 2 having a plurality of uneven surfaces in the right-and-left directions. A supply inlet 3 for sand is provided so that it upwardly passes through the center of the upper part of the core cavity 2. A plurality of ventholes 4'–7' are provided at proper intervals therebetween in the side parts of the core cavity 2 so that they outwardly pass therethrough. Vent plugs 9 are engaged with respective ventholes 4'–7'. A blow head 11 is press-contacted with the upper part of the core box 1. A sand-supply inlet 13, which is opened or closed by an opening-and-closing lid 12, is provided on the upper wall of the blow head 11.

An air-supply hole 14 is provided in the upper part of the blow head 11. The air-supply hole 14 communicates with a source of compressed air (not shown) via main piping 16 and a valve 17. Three branched pipes 18–20 are provided at positions downstream from the valve 17 in the main piping 16. The end of the branched pipe 18 communicates with a venthole 5', the end of the branched pipe 19 communicates with a venthole 6', and the end of the branched pipe 20 communicates with a venthole 7'. The branched pipes 18–20 are equipped with directional control valves 18A–20A. These control valves are for switching the connections between two directions. One is for connecting the main piping 16 to the ventholes 5'–7' and the other is for connecting the ventholes 5'–7' to the atmosphere. In the drawing molding sand is denoted by S.

The blow head 11, supplied with sand for molding the core, is press-contacted with the core box 1, with a blow hole 10 of the head 11 communicating with the sand-supply inlet 3. The directional control valves 18A–20A are then connected to the atmosphere, and the valve 17 is opened so that the molding sand S in the blow head 11 is blown into the core cavity 2 to fill it preparatorily. After that the valve 17 is closed. In this state not all the corners of the core cavity 2 are fully filled with highly-compacted sand S by just the blowing actions.

After the directional control valves 18A–20A have been switched to the directions wherein the ventholes 5'–7' are connected to the main piping 16, the valve 17 is opened to abruptly supply compressed air via the blow head 11 and ventholes 5'–7' into the core cavity 2, so that the upper parts of the sand S in the blow head 11 are press-pushed, and so that the farthest positions (below the venthole 5') in the cavity 2 from the sand-supply inlet 3 are filled with highly-compacted sand S. After that the valve 17 is closed. In this state the remaining parts of the sand for molding the core, e.g., sand between blow hole 10 and the middle part of core cavity 2, are prevented from being blocked by the actions of the pressure of air introduced from upper and lower holes 14, 5', 6', and 7, so that the farthest end parts are effectively pressurized.

After the directional control valve 18A is switched to the direction wherein the venthole 5' is connected to the atmosphere, the valve is opened so that compressed air is supplied into the blow head 11, and into the core cavity 2 via the ventholes 6' and 7'. Thus, the second farthest parts (those positions below the venthole 6') of the core cavity 2 from the sand-supply inlet 3 are filled with highly-compacted sand S. The parts of the cavity 2 around the venthole 7' are also filled with highly compacted sand S by supplying compressed air via just the valve 20A. Thus, the sand S for molding the core, which has been preparatorily drawn into the core cavity 2, is uniformly and highly compacted all over the cavity. That is, the sand S is sequentially compacted, from the sand at the farthest positions to the sand at the nearest positions from the sand-supply inlet 3, by sequentially changing the positions for supplying compressed air to sequentially pressurize the sand S.

As is clear from the above descriptions, finally all sand for molding a core drawn into a core cavity can be uniformly and highly compacted even if its shape is oblong or complex. This is achieved because this invention is constituted such that sand for molding the core is drawn into the cavity to preparatorily fill it, and after that the thus prepared sand is repeatedly and sequentially compacted by impulsively pressurizing the sand, starting from the sand at its outermost positions.

What is claimed is:

1. A method of filling a core cavity with molding sand, where the core cavity is defined by a core box, said method comprising the steps of:

preparatorily filling the core cavity with some of the sand by press-contacting a blow head against an upper surface of the core box so that the blow head is aligned with an inlet of the core box, introducing the molding sand into the blow head, and introducing said some of the sand into the core cavity from the blow head, impulsively press-filling those parts of the core cavity which are the farthest from the inlet by abruptly introducing compressed air into the core cavity via a plurality of openings provided along the core box at appropriate distances therebetween, and impulsively press-filling other parts of the cavity, by sequentially introducing additional quantities of compressed air via different subsets of the openings, wherein the subsets are selected so as to cause parts of the cavity to be filled in order of decreasing distance from the inlet.

2. The method of claim 1 wherein the step of preparatorily filling the core cavity includes the step of:

depressurizing the core cavity so that said some of the sand is sucked into said core cavity from the blow head.

3. The method of claim 1, wherein the step of impulsively press-filling the other parts of the core cavity includes the step of vacuum-depressuring the core cavity and the blow head before introduction of each of said additional quantities of compressed air via each of said different subsets of the openings.

* * * * *